US008834123B2

(12) United States Patent
Morrison

(10) Patent No.: US 8,834,123 B2
(45) Date of Patent: Sep. 16, 2014

(54) TURBOMACHINERY COMPONENT

(75) Inventor: Daniel K. Morrison, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 689 days.

(21) Appl. No.: 12/951,306

(22) Filed: Nov. 22, 2010

(65) Prior Publication Data

US 2011/0158811 A1 Jun. 30, 2011

Related U.S. Application Data

(60) Provisional application No. 61/290,713, filed on Dec. 29, 2009.

(51) Int. Cl.
*F01D 5/16* (2006.01)
*F01D 5/30* (2006.01)
*F01D 5/14* (2006.01)

(52) U.S. Cl.
CPC ..... *F01D 5/147* (2013.01); *F01D 5/3023* (2013.01); *F01D 5/16* (2013.01); *F05D 2260/94* (2013.01)
USPC ..... 416/193 A; 416/239

(58) Field of Classification Search
USPC ..... 416/500, 193 A, 204 R, 219 R, 223 R, 416/235, 239
See application file for complete search history.

(56) References Cited

U.S. PATENT DOCUMENTS 3,656,864 A 4/1972 Wagle
4,120,607 A 10/1978 Coplin
4,260,331 A 4/1981 Goodwin
4,743,166 A * 5/1988 Elston et al. ..... 416/215
4,784,575 A 11/1988 Nelson et al.
4,872,812 A 10/1989 Hendley et al.
5,478,207 A 12/1995 Stec
5,741,119 A 4/1998 Heppenstall
6,033,185 A * 3/2000 Lammas et al. ..... 416/193 A
6,042,336 A 3/2000 Bulgrin et al.
6,419,447 B1 * 7/2002 Watanabe et al. ..... 415/191
6,575,704 B1 6/2003 Tiemann
6,752,594 B2 6/2004 Miller et al.
6,769,877 B2 * 8/2004 Martin et al. ..... 416/193 A
6,851,932 B2 2/2005 Lagrange et al.
6,860,715 B2 3/2005 Sekularac
6,994,526 B2 2/2006 Furman et al.
7,121,803 B2 * 10/2006 Gautreau et al. ..... 416/193 A
7,594,799 B2 9/2009 Miller et al.
2001/0024614 A1 9/2001 Szwedowicz (Continued)

OTHER PUBLICATIONS

International Search Report and Written Opinion, PCT/US2010/62369, Rolls-Royce Corporation, Mar. 31, 2011.

*Primary Examiner* — Ned Landrum
*Assistant Examiner* — Aaron Jagoda
(74) *Attorney, Agent, or Firm* — Krieg DeVault LLP

(57) ABSTRACT

A turbomachinery blade for a gas turbine engine is provided and includes an airfoil extending between a leading edge and a trailing edge. In one embodiment the turbomachinery blade is a compressor blade. The blade can include a platform attached to the airfoil on one side, the other side being attached to a stalk having a lower attachment portion useful for being received in a compressor disk. The blade includes an undercut beneath a portion of the airfoil, preferably beneath the leading edge and/or trailing edge of the airfoil. In one form the undercut is located in a corner of the platform and extends partially along two sides of the platform.

13 Claims, 3 Drawing Sheets

(56) References Cited

U.S. PATENT DOCUMENTS

| | | | | |
|---|---|---|---|---|
| 2002/0146322 | A1 | 10/2002 | Yeo et al. | |
| 2003/0231957 | A1 | 12/2003 | Anderson et al. | |
| 2004/0013528 | A1 | 1/2004 | Leathart | |
| 2004/0062652 | A1 | 4/2004 | Grant et al. | |
| 2004/0219024 | A1 | 11/2004 | Soupizon et al. | |
| 2005/0047917 | A1 | 3/2005 | Brock et al. | |
| 2006/0073021 | A1 * | 4/2006 | Garner | 416/220 R |
| 2007/0031259 | A1 * | 2/2007 | Dube et al. | 416/193 A |
| 2007/0269313 | A1 * | 11/2007 | Nadvit et al. | 416/193 A |

* cited by examiner

TURBOMACHINERY COMPONENT

CROSS REFERENCE TO RELATED APPLICATIONS

The present application claims the benefit of U.S. Provisional Patent Application 61/290,713, filed Dec. 29, 2009, and is incorporated herein by reference.

TECHNICAL FIELD

The present invention relates to rotating gas turbine engine components, and more particularly, but not exclusively, to reducing vibratory stresses in rotating compressor blades of gas turbine engines.

BACKGROUND

Improving the ability of gas turbine engine rotating components to withstand stresses, such as vibratory stresses for example, remains an area of interest. Some existing systems, however, have various shortcomings relative to certain applications. Accordingly, there remains a need for further contributions in this area of technology.

SUMMARY

One embodiment of the present invention is a unique turbomachinery blade. Other embodiments include apparatuses, systems, devices, hardware, methods, and combinations for reducing stresses in a turbomachinery blade. Further embodiments, forms, features, aspects, benefits, and advantages of the present application shall become apparent from the description and figures provided herewith.

BRIEF DESCRIPTION OF THE DRAWINGS

The components in the figures are not necessarily to scale, emphasis instead being placed upon illustrating the principles of the invention. Moreover, in the figures, like reference numerals designate corresponding parts throughout the different views.

DETAILED DESCRIPTION OF THE ILLUSTRATIVE EMBODIMENTS

Figure 1:
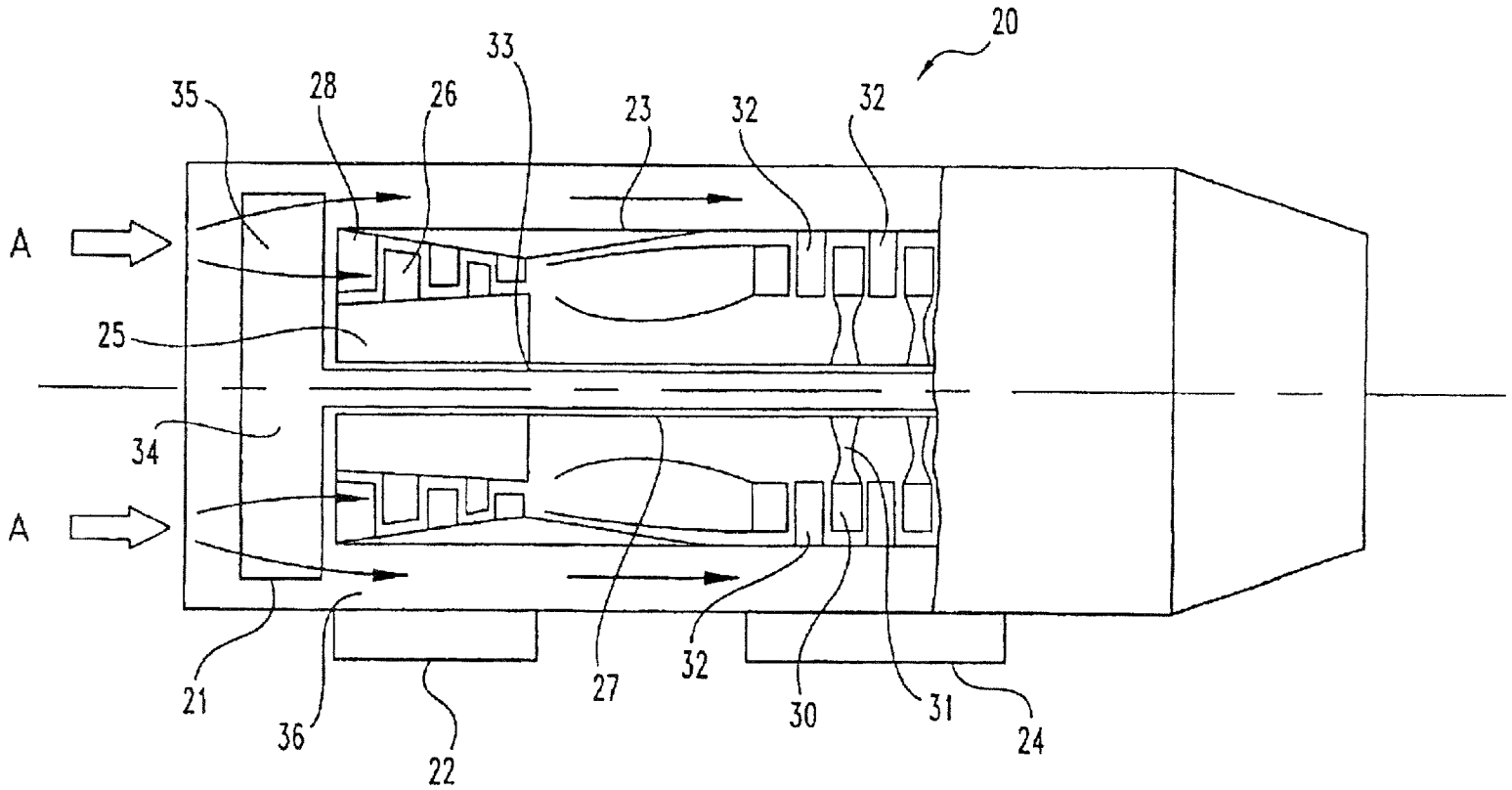
FIG. 1 depicts one embodiment of a gas turbine engine.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated one embodiment of a gas turbine engine 20 which includes a fan section 21, a compressor section 22, a combustor section 23, and a turbine section 24 that are integrated together to produce an aircraft flight propulsion engine. This type of gas turbine engine is generally referred to as a turbo-fan. Other types of gas turbine engines are also contemplated, such as, but not limited to, turboprops, turbojets, and turboshafts. It is important to realize that there are a multitude of ways in which the gas turbine engine components can be linked together. The gas turbine engine can have any number of spools. One form of a gas turbine engine includes a compressor, a combustor, and a turbine that have been integrated together to produce an aircraft flight propulsion engine. As used herein, the term "aircraft" includes, but is not limited to, helicopters, airplanes, fixed wing vehicles, variable wing vehicles, rotary wing vehicles, unmanned combat aerial vehicles, tailless aircraft, hover crafts, and other vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

The compressor section 22 includes a rotor 25 having a plurality of compressor blades 26 coupled thereto. The rotor 25 is affixed to a shaft 27 that is rotatable within the gas turbine engine 20. A plurality of compressor vanes 28 are positioned within the compressor section 22 to direct the fluid flow relative to blades 26. Turbine section 24 includes a plurality of turbine blades 30 that are coupled to a rotor disk 31. The embodiment of the turbine section 24 depicted in FIG. 1 includes a relatively low pressure turbine and a relatively high pressure turbine. The rotor disk 31 is affixed to the shaft 27, which is rotatable within the gas turbine engine 20. Energy extracted in the turbine section 24 from the hot gas exiting the combustor section 23 is transmitted through shaft 27 to drive the compressor section 22. Further, a plurality of turbine vanes 32 are positioned within the turbine section 24 to direct the hot gaseous flow stream exiting the combustor section 23.

The turbine section 24 provides power to a fan shaft 33, which drives the fan section 21. The fan section 21 includes a fan 34 having a plurality of fan blades 35. Air enters the gas turbine engine 20 in the direction of arrows A and passes through the fan section 21 into the compressor section 22 and a bypass duct 36. Further details related to the principles and components of a conventional gas turbine engine will not be described herein as they are believed known to one of ordinary skill in the art.

Figure 2:
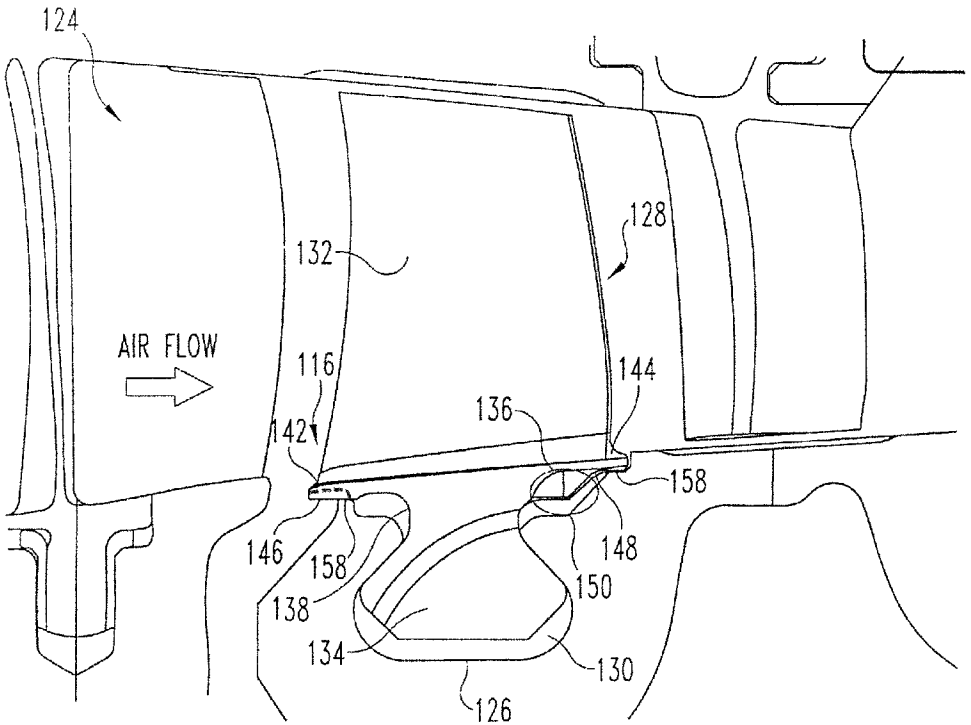
FIG. 2 depicts one embodiment of a compressor blade in a compressor wheel of a gas turbine engine.

Referring to FIG. 2 and with continuing reference to FIG. 1, as previously set forth, the compressor stage 22 may include a rotor or compressor wheel assembly 116. A cross sectional view of a portion of the compressor wheel assembly 116 positioned in compressor housing 124 is set forth in FIG. 2. The compressor wheel assembly 116 preferably comprises a compressor wheel 126 and one or more compressor blades 128. The orientation of the compressor blades 128 and the compressor wheel 126 is such that air flows in a generally axially aft direction as indicated by the arrow of FIG. 2 labeled "AIR FLOW". The compressor wheel 126 is generally normal to air flow and extends circumferentially about a center axis of the gas turbine engine. The compressor blade 128 depicted in FIG. 2 can be a compressor blade from any location within the compressor section 22. To set forth just one non-limiting example, the compressor blade 128 depicted in FIG. 2 can be coupled to a fourth rotor in a multi-rotor compressor.

The compressor wheel 126 includes a blade retaining slot 130 disposed therein. In the illustrative embodiment, the blade retaining slot 130 preferably has a dovetail shape. Other slot configurations and/or shapes are contemplated as within the scope of the present application. As discussed further below, an attachment portion of the compressor blades 128 fits within and engages the blade retaining slot 130, the compressor blades 128 extending circumferentially around a center axis of the gas turbine engine 20. Although not illustrated, in some forms the compressor wheel 126 and blades 128 can be formed as a unitary whole.

Figure 3:
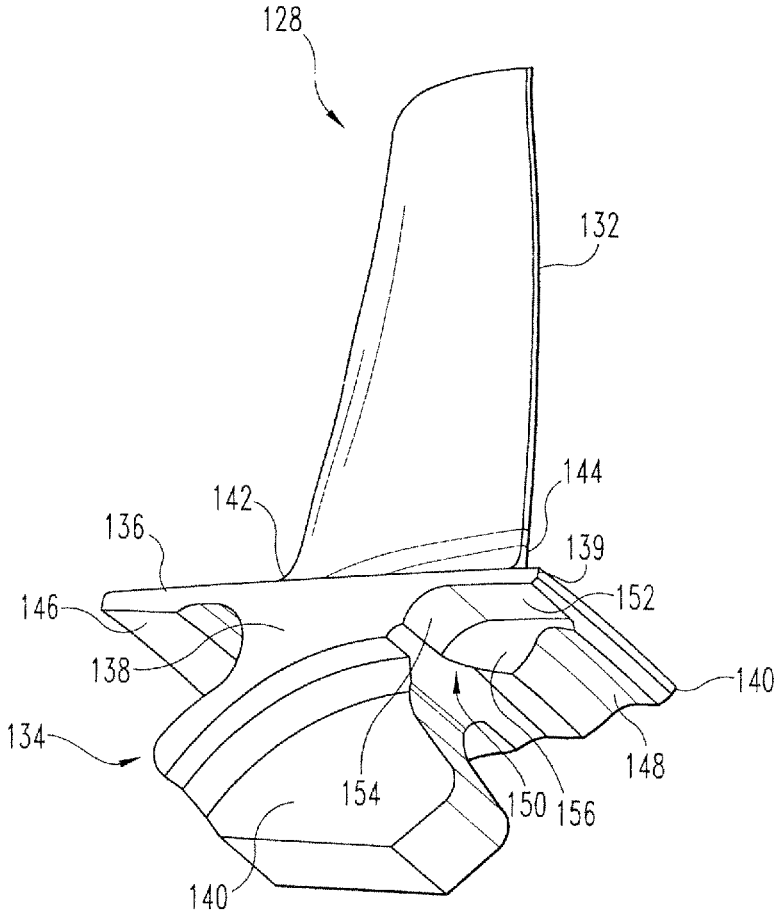
FIG. 3 depicts a view of a compressor blade having one embodiment of an undercut positioned beneath a trailing edge of an airfoil portion.

Referring collectively to FIGS. 2 and 3, each compressor blade 128 includes an airfoil section 132 and a stalk 138. The stalk 138 includes a root section 134 with an attachment portion 141. The stalk 138 also includes a platform portion 136 that provides a surface for the smooth passage of airflow thereover. The root section 134 is mountable within the blade retaining slot 130 and may be inserted therein through a loading slot (not shown). The root section 134 has an attachment portion 141 that fits within and engages the blade retaining slot 130 of the compressor wheel 126 as illustrated. An upper portion of the stalk 138 defines the platform 136 of the compressor blade 128. The platform 136 extends between first end 139 and opposite second end 140. In one form when completely assembled, adjacent compressor blades 128 are preferably positioned so that platforms 136 of adjacent compressor blades 128 abut one another.

The airfoil section 132 of each compressor blade 128 includes a leading edge 142 and a trailing edge 144. The airfoil section 132 includes a number of characteristics such as, but not limited to, sweep, camber and twist, to set forth just a few non-limiting examples. In one form the airfoil section 132 can be highly swept. In any event, various embodiments of the airfoil section 132 can have a variety of different characteristics.

The stalk 138 includes a stalk leading edge section 146 and a stalk trailing edge section 148. An upper portion of the stalk leading edge section 146 and the stalk trailing edge section 148 define a portion of the platform 136 and extends beyond the root 134 to the first and second opposite ends 139 and 140, respectively. In some forms the stalk leading edge section 146 is positioned below a portion of the leading edge 142 of the airfoil section 132 and the stalk trailing edge section 148 is positioned below a portion of the trailing edge 144 of the airfoil section 132.

As illustrated in FIG. 3, the compressor blade 128 is shown having one embodiment of an undercut 150 that can be used in some applications to mitigate the effects of vibrations such as the stresses that accompany vibrations. Though the undercut 150 is shown relative to a compressor blade in the illustrative embodiment, it can be used in other types of gas turbine engine blades. In the illustrative embodiment the undercut 150 is positioned beneath the trailing edge 144 of the airfoil section 132 which in some applications is a critical area of stress. In other embodiments the undercut 150 can alternatively and/or additionally be positioned beneath the leading edge 142 which can also be a critical area of stress. The undercut 150 serves to vary the stiffness of the structure. In one form the stiffness of the structure away from the undercut 150 drives the load path away from that area. When the undercut area is placed under a trailing edge or leading edge of the blade 128, the stiffness is driven away thus driving the load path away from that area. The reduction in load across that area reduces vibratory stress for a given vibration. The undercut 150 can be created by removing some amount of material from the blade 128 after it is formed, and/or forming the blade 128 at the same time as at least some portion of the undercut 150. To set forth just a few non-limiting examples, the undercut 150 can be formed by milling away select portions of the stalk and/or platform. The blade 128 having the undercut 150 can also be cast, forged, or assembled from separate pieces (airfoil, platform, stalk, root section). The undercut can be formed in the platform 136, the stalk 138, or both.

The illustrated shape of undercut 150 is exemplary and other shapes are contemplated as within the scope of the application. In one embodiment the undercut 150 begins at first end 139 and extends only a portion of the way toward opposite second end 140. However, it is also contemplated as within the scope of the application that the undercut might not include either of ends 139 and 140, but instead only span some portion of the length between the two ends. The depth, width and thickness of the undercut 150 may be tailored as desired to achieve a desired property, such as a high cycle fatigue design requirements for a respective gas turbine engine. In some embodiments the undercut 150 can be disposed equally on either side of the leading edge 142 and/or trailing edge 144. In some forms the undercut 150 can be positioned unequally on either side of the leading edge 142 and/or trailing edge 144. The undercut 150 can also extend along the blade 128 to any given location along either or both sides of the platform 136. In some cases such location can be referred to as a chord location. Various other shapes and combinations are contemplated.

As illustrated in FIG. 3, the undercut 150 may include an upper surface 152, a side surface 154, and a back surface 156. The height, width and depth of the undercut 150 defines the position of the upper surface 152, the side surface 154, and the back surface 156. In the illustrative embodiment the upper surface 152 includes a portion of the lower surface of platform 136. The side surface 154 can be positioned within the stalk 138 a predetermined distance from a trailing outside edge of the platform 136. The back surface 156 may be positioned at a predetermined depth within the stalk 138 from an end 139 of the platform 136. Though the top surface 152 and back surface 156 are shown having relatively flat shapes, other embodiments can have a variety of other shapes. In addition, though the side surface 154 is shown having a curvilinear shape, in other embodiments the side surface 154 can have other shapes. Not all embodiments need have a well defined upper surface 152, side surface 154, or back surface 156. In some forms the undercut 150 can take other forms such as a scoop or scallop. In short, the undercut 150 can have a variety of shapes, forms, and sizes.

As illustrated in FIG. 2, having a complete platform 136 may be useful in some embodiments because of the need to create a fluid tight seal, or relatively fluid tight seal, between a lower surface 158 of the platform 136 and the compressor wheel 126. As previously mentioned, during assembly, a plurality of compressor blades 128 are preferably positioned in the compressor wheel 126 such that adjacent compressor blades 128 will be positioned so that the platforms 136 of adjacent compressor blades 128 abut one another at respective ends 139 and 140.

In one aspect of the present application the vibration mitigating undercut can be formed on an underside surface of the platform beneath the leading edge and/or trailing edge of the airfoil. The stiffness of the stalk away from the undercut drives the load path created during operation of the gas turbine engine away from the leading and/or trailing edge of the airfoil. The reduction in load across the critical areas reduces the vibratory stress in the critical feature for a given vibration. The depth, width and thickness of the undercut can be tailored to achieve high cycle fatigue design requirements of gas turbine engines utilizing the compressor blade.

In one embodiment of the application there is a compressor blade for a gas turbine engine. The blade includes an airfoil extending between a leading edge and a trailing edge. The blade further includes a stalk having a lower attachment portion and an upper portion defining a platform. The platform has a first side and a second side. A portion of the first side of the platform is connected to the airfoil. The blade further includes at least one undercut in the stalk beneath a portion of the airfoil.

In one refinement of the application the undercut in the stalk is located beneath at least a portion of the trailing edge of the airfoil.

In another refinement of the application the undercut in the stalk is located beneath at least a portion of the leading edge of the airfoil.

In another refinement of the application the airfoil is highly swept.

In another refinement of the application the platform extends between a first end and a second end. The undercut is in the platform, and the undercut begins at the first end and extends only a portion of the way toward the second end.

In another refinement of the application the undercut is in the platform and the undercut is located beneath at least a portion of the leading edge of the airfoil. The platform includes a second undercut located beneath at least a portion of the trailing edge of the airfoil.

In another refinement of the application the attachment portion is dovetail shaped.

In another embodiment of the application there is a compressor blade for a gas turbine engine. The blade includes a stalk. A lower portion of the stalk defines an attachment section. An upper portion of the stalk defines a platform. The platform has an upper surface and a lower surface. The upper and lower surfaces extend between a first outside edge and a second outside edge. An airfoil is attached to the upper surface of the platform. The airfoil has a leading edge positioned at about the first outside edge. The airfoil also has a trailing edge positioned at about the second outside edge. The blade further includes an undercut in the lower surface of the platform. At least a portion of the undercut is positioned beneath at least one of the leading edge or the trailing edge of the airfoil.

In one refinement the undercut is positioned beneath at least a portion of the trailing edge of the airfoil.

In another refinement the undercut is positioned beneath at least a portion of the leading edge of the airfoil.

In another refinement there is a second undercut in the bottom surface of the platform. The second undercut is positioned beneath at least a portion of the leading edge of the airfoil.

In another refinement the attachment section is dovetail shaped.

In another refinement the airfoil is highly swept.

In another refinement the undercut in the platform begins at the first outside edge and extends only a portion of the way toward the second outside edge.

In another embodiment of the application there is a compressor stage of a gas turbine engine. The compressor stage includes a compressor wheel having a plurality of blade retaining slots. The compressor stage further includes a plurality of compressor blades. Each blade is positioned in one of the blade retaining slots. Each compressor blade includes an airfoil having a leading edge and a trailing edge. Each compressor blade further includes a stalk defining a platform having an upper side and a lower side. The airfoil is connected to the upper side of the platform. The stalk includes an attachment portion mountable within the respective blade retaining slot. The stalk further includes means for driving the load pathway away from at least a portion of the airfoil for loads generated by rotation of the compressor wheel.

In one refinement the means for driving the load pathway away from at least a portion of the airfoil comprises at least one undercut located in the stalk.

In another refinement the undercut is positioned beneath at least a portion of the trailing edge of the airfoil.

In another refinement the undercut is positioned beneath at least a portion of the leading edge of the airfoil.

In another refinement the airfoil is highly swept.

In another refinement there is a second undercut located beneath the platform at a leading edge of the airfoil.

One aspect of the present application provides a compressor blade for a gas turbine engine, comprising an airfoil extending between a leading edge and a trailing edge and operable to affect a change in total pressure between an upstream side of the airfoil and a downstream side of the airfoil, a stalk having a lower attachment portion and an upper portion defining a platform, the platform having a first side and a second side, a portion of the first side of the platform being coupled to the airfoil, and at least one undercut in the stalk beneath a portion of the airfoil.

Another aspect of the present application provides an apparatus comprising a rotatable blade of a gas turbine engine including a stalk having a lower portion defining an attachment section and an upper portion of the stalk defining a platform, the platform having an upper surface and a lower surface an airfoil extending from the upper surface of the platform, and an undercut in the lower surface of the platform and partially extending along one side of the platform, at least a portion of the undercut positioned beneath at least one of the leading edge or the trailing edge of the airfoil.

A further aspect of the present application provides a compressor stage of a gas turbine engine, comprising a compressor wheel having a plurality of blade retaining slots, a plurality of compressor blades, each blade being positioned in one of the blade retaining slots, the plurality of compressor blades comprising an airfoil having a leading edge and a trailing edge, a stalk defining a platform having an upper side and a lower side, the airfoil being connected to the upper side of the platform, wherein the stalk includes an attachment portion mountable within the respective blade retaining slot, the stalk further including means for driving the load pathway away from at least a portion of the airfoil.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A compressor blade for a gas turbine engine, comprising:

an airfoil extending between a leading edge and a trailing edge and operable to affect a change in total pressure between an upstream side of the airfoil and a downstream side of the airfoil;

a stalk having a lower attachment portion and an upper portion defining a platform, the platform having a first side and a second side, a portion of the first side of the platform being coupled to the airfoil, the platform extending between first and second opposite ends, the platform including a leading edge having two corners at the upstream side of the airfoil at the respective first and second opposite ends of the platform, and a trailing edge having two corners at the downstream side of the airfoil at the respective first and second opposite ends of the platform; and only first and second single corner undercuts, the first single corner undercut located only beneath a first single corner of the leading edge of the platform and only beneath a portion of the leading edge of the airfoil, the first single corner undercut located at the second end of the platform;

the second corner undercut located only beneath a second single corner of the trailing edge of the platform and only beneath a portion of the trailing edge of the airfoil, the second single corner undercut located at the first end of the platform.

2. The compressor blade of claim 1, wherein the airfoil is disposed internal to a gas turbine engine, the airfoil part of a rotatable component.

3. The compressor blade of claim 1, wherein the undercut begins at the first end and extends only a portion of the way toward the second end.

4. The compressor blade of claim 1, wherein the attachment portion is dovetail shaped.

5. An apparatus comprising:

a rotatable blade of a gas turbine engine including a stalk having a lower portion defining an attachment section and an upper portion of the stalk defining a platform, the platform having an upper surface and a lower surface;

an airfoil extending from the upper surface of the platform and having a leading edge and a trailing edge;

the platform having a leading edge side and a trailing edge side and first and second opposite ends each extending between the leading edge side and the trailing edge side; and only first and second corner undercuts in the lower surface of the platform the first corner undercut partially extending along the leading edge side of the platform and partially along the second end of the platform and being positioned beneath only the leading edge of the airfoil; and the second corner undercut partially extending along the trailing edge side of the platform and partially along the first end of the platform and being positioned beneath only the trailing edge of the airfoil.

6. The apparatus of claim 5, wherein the attachment section is dovetail shaped.

7. A gas turbine engine including a compressor wheel having a blade retaining portion and at least one apparatus comprising the rotatable blade, the airfoil, and the undercut, according to claim 5, positioned in the blade retaining portion.

8. The apparatus of claim 5, wherein the upper and lower surfaces extend between a first outside edge and a second outside edge, the airfoil having the leading edge positioned at about the first outside edge and the trailing edge positioned at about the second outside edge, wherein the first corner undercut in the platform begins at the first outside edge and extends only a portion of the way toward the second outside edge.

9. A compressor stage of a gas turbine engine, comprising:

a compressor wheel having a plurality of blade retaining slots;

a plurality of compressor blades, each blade being positioned in one of the blade retaining slots, the plurality of compressor blades comprising:

an airfoil having a leading edge and a trailing edge;

a stalk defining a platform having an upper side and a lower side, the airfoil being connected to the upper side of the platform, wherein the stalk includes an attachment portion mountable within the respective blade retaining slot, the platform having a leading edge side and a trailing edge side and first and second opposite ends each extending between the leading edge side and the trailing edge side; the stalk further including first means for driving a load pathway away from only a leading edge portion of the airfoil and being located at only the leading edge side and only the second end of the platform; and second means for driving a load pathway away from only a trailing edge portion of the airfoil and being located at only the trailing edge side and only the first end of the platform.

10. The compressor stage of claim 9, wherein the first means for driving the load pathway away from only the leading edge portion of the airfoil includes an undercut located in the stalk.

11. The compressor stage of claim 10, wherein the undercut is positioned beneath only a portion of the leading edge of the airfoil.

12. The compressor stage of claim 9, which further includes a gas turbine engine, the compressor wheel disposed within the engine.

13. The compressor stage of claim 9, wherein the first means for driving the load pathway away from only the leading edge portion of the airfoil includes a relatively flat upper side and lateral side.

* * * * *